141-237
10/22/85 OR 4,548,245

United States Patent [19]
Crandell et al.

[11] Patent Number: 4,548,245
[45] Date of Patent: Oct. 22, 1985

[54] DISPOSABLE/REUSABLE DISPENSER FOR DISPENSING CONTAMINATABLE AND NONCONTAMINATABLE LIQUIDS

[75] Inventors: William H. Crandell, Hobe Sound, Fla.; John L. Moren, Arlington, Va.; Paul Q. Ruona, Silver Spring, Md.

[73] Assignee: Dynatech Laboratories Incorporated, Alexandria, Va.

[21] Appl. No.: 472,104

[22] Filed: Mar. 4, 1983

[51] Int. Cl.[4] ..... B01L 11/00
[52] U.S. Cl. ..... 141/237; 222/330; 422/100
[58] Field of Search ..... 141/1, 237, 2, 23, 25, 141/26; 222/157, 330, 340, 382, 401, 462, 464, 478, 571; 422/100

[56] References Cited

U.S. PATENT DOCUMENTS

| | | | |
|---|---|---|---|
| 1,879,328 | 9/1932 | Kremmling | 222/478 |
| 3,353,721 | 11/1967 | Love | 222/330 X |
| 3,356,462 | 12/1967 | Cooke et al. | 422/102 |
| 3,693,673 | 9/1972 | Oates | 141/237 |
| 3,990,403 | 11/1976 | Jacobs | 222/420 X |
| 4,142,668 | 3/1979 | Lee | 422/100 X |
| 4,215,092 | 7/1980 | Suovaniemi et al. | 422/100 X |

FOREIGN PATENT DOCUMENTS

| | | | |
|---|---|---|---|
| 635572 | 6/1927 | France | 222/478 |

*Primary Examiner*—Stephen Marcus
*Assistant Examiner*—Mark Thronson
*Attorney, Agent, or Firm*—LeBlanc, Nolan, Shur & Nies

[57] ABSTRACT

A fully disposable self-contained manifold-type multiple stroke dispenser having sufficient capacity for dispensing 96, microliter quantities of liquid without refill to accommodate a standard 96-well microtitration plate.

25 Claims, 12 Drawing Figures

Fig.8
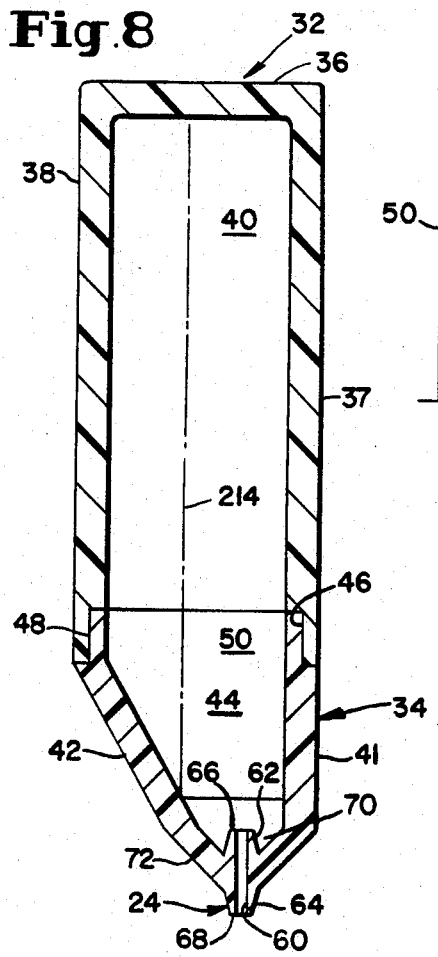
Fig.12
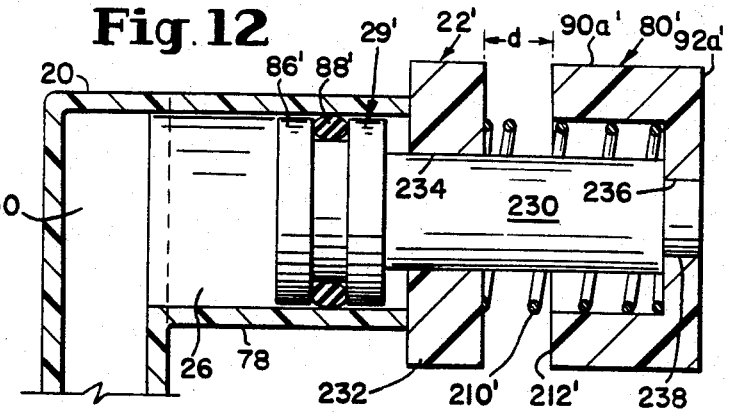
Fig.11
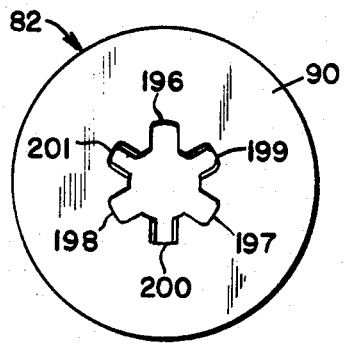
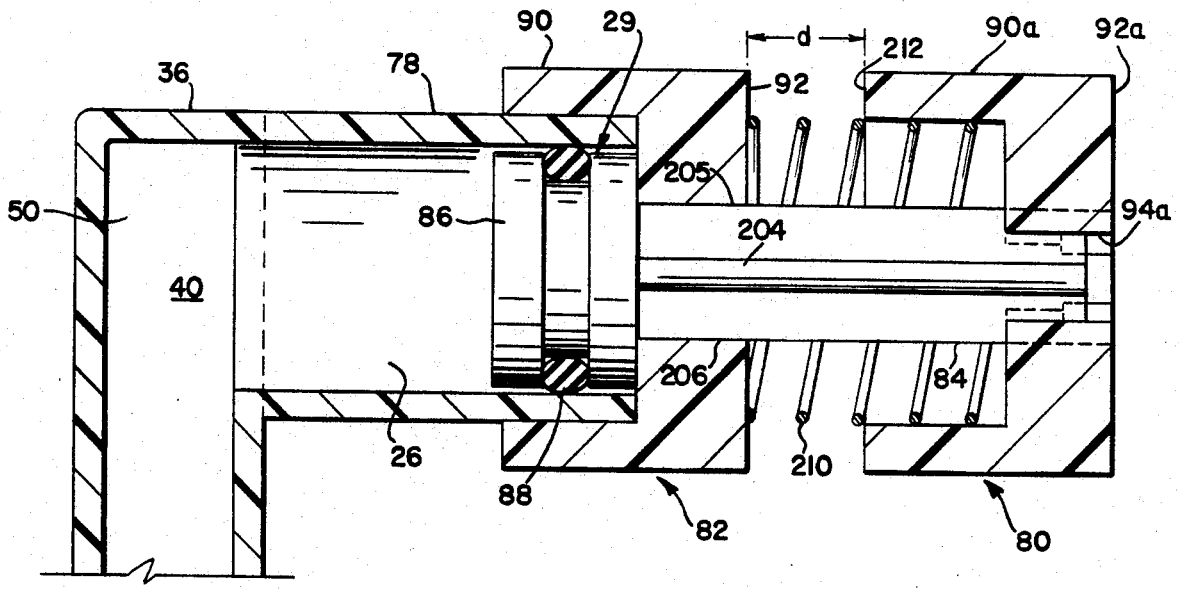
Fig.10

DISPOSABLE/REUSABLE DISPENSER FOR DISPENSING CONTAMINATABLE AND NONCONTAMINATABLE LIQUIDS

FIELD OF INVENTION

This invention relates to devices for dispensing small quantities of bacterial and other liquid samples in medical and biological laboratory type tests.

BACKGROUND

Prior to this invention, pipetting devices have been used for dispensing bacteria-containing suspensions into suitable receptacles such as the wells of a microtitration plate (or microtest plate, as it is also called). In addition, pin inoculators have been used for adding bacteria to a nutrient broth or other liquid suspension. In both cases the dispensing instrument or at least parts thereof become contaminated, thus requiring the contaminated parts to be either discarded or sterilized.

Devices of the foregoing types are used for dispensing contaminating materials in various tests. In an antimicrobial susceptability test, for example, a pipette is customarily used to pick up small quantities of a premixed suspension of bacteria in a nutrient broth and to dispense the picked up samples into separate microtest wells containing different concentrations of antibodies. Where used for this purpose, the pipette is required to be capable of reproducibly dispensing uniform volumes of liquid samples in microliter quantities to assure that equal amounts of bacteria are intermingled with the different concentrations of antibodies.

Pipettes which meet the foregoing requirements are customarily of the mechanical type which typically have a piston and cylinder assembly for applying a suction to pick up liquid samples. Pipettes of this type are expensive and therefore require reuse to justify their cost. Some pipetting devices of this type are equipped with disposable tips to avoid the inconvenience of sterilization provided that the device is carefully used to confine contamination to the liquid pick-up tips.

Instead of premixing the bacteria with the nutrient broth, an antimicrobial susceptability test may be carried out by using a reusable pipette type dispenser just to dispense a bacteria free broth into the microtest wells and by thereafter using a disposable pin inoculator to transfer the bacteria directly from a culture to the microtest wells. Use of disposable pin inoculators eliminates the contamination problem, but gives rise to two significant drawbacks.

First, the amount or number of bacteria picked up with a pin inoculator depends to a significant extent upon operator technique, making it somewhat difficult to repeatedly pick up equal, preselected amounts of bacteria. Second, a greater number of steps or operations are involved as compared with the procedure where the bacteria are premixed with the nutrient broth.

Accordingly, pipette type dispensers and pin inoculators both have drawbacks when used for the foregoing purposes. Furthermore, known pipetting devices of the convenient hand-held type are not capable of dispensing 96 liquid samples without refill to accommodate a standard 96-well microtitration plate. Some pipette type dispensers are equipped with 96 channels or tips to load all 96 wells without refill, but they are of the relatively expensive bench type such as the one described in U.S. Pat. No. 3,568,735, which issued to J. F. Lancaster on Mar. 9, 1971.

SUMMARY AND OBJECTS OF INVENTION

The major aim and purpose of this invention resides in the provision of a novel, hand-held, disposable dispenser which overcomes the shortcomings of prior pipette type dispensers and pin innoculators.

The disposable dispenser of this invention comprises a small, hollow manifold or body defining a liquid reservoir and terminating at its lower end in a straight row of dispensing tips. The liquid flow passages through the dispensing tips open directly into the manifold's liquid reservoir or storage chamber.

In this invention the entire hollow interior of the manifold serves as the liquid reservoir. This construction affords sufficient storage capacity for delivering the required volumes of liquid samples to all 96 wells in a standard microtitration plate without refill. It also serves to minimize the size of the dispenser so that it can conveniently be held and carried in one hand as well as being hand-held for operation.

The dispenser of this invention differs from pipettes in that the liquid reservoir is common to the dispensing tips and is filled through a separate fill port. To dispense liquid stored in the manifold, a manually operable plunger or piston assembly is mounted on the manifold and has a spring biased plunger or piston slidably mounted in the manifold's fill port. The plunger is manually depressable to increase the manifold's air pressure above the stored liquid for simultaneously discharging equal, premetered, microliter quantities of the stored liquid through the dispensing tips for each full dispensing stroke of the plunger. Successive plunger dispensing strokes result in the discharge of successive liquid samples, all having equal or substantially equal volumes.

The dispenser operates in such a way that the total volumes of dispensed liquid is fixed by the length of the plunger stroke. Interchangeable plunger assemblies having different preselected dispensing strokes thus provide a convenient means for dispensing different volumes of liquid.

Furthermore, the plunger assembly is simple in construction, is easy to operate and has relatively few parts. In addition to its dispensing function, the plunger assembly serves as a stopper for closing the fill port and is removable to permit a supply of liquid (such as a suspension of bacteria in a nutrient broth) to be poured into the manifold preparatory to a dispensing operation.

Because of its low cost and disposability, the dispenser of this invention is particularly suitable for handling suspensions containing bacteria or other contaminents such as virus and radioactive materials. Furthermore, the dispenser of this invention is ruggedly constructed for reuse in non-contaminating applications.

Preferably, the manifold has 12 dispensing tips, corresponding to the number of wells in each of the eight 12-well rows of a standard 96-well microtitration plate. This construction therefore permits liquid samples to be delivered to each 12-well row in a single dispensing operation. By shifting the dispenser from one row to the next, liquid samples can therefore be delivered to all 96 wells in just eight plunger strokes.

The dispensing tips are configured to impair the collection of bubbles at their inner ends within the manifold's reservoir. The tips are also configured to minimize the occurrence of hanging drops at their outer ends. These features advantageously enhance the accuracy of the dispensed liquid volumes.

The dispensing tips are also configured to interfittingly seat against the beveled or conically contoured lips or mouths of the microtest wells. This seating configuration serves two purposes. First, it centers the dispensing tips on the wells. Second, it establishes a semi-fluid tight seal to inhibit the escape of airborne liquid droplets from the wells, thereby diminishing the chances of spreading contamination where the airborne droplets contain bacteria or other contaminants.

With the foregoing in mind, a further object of this invention resides in the provision of a fully-disposable, self-contained manifold-type, multistroke dispenser having sufficient capacity to handle a standard, 96-well microtitration plate without refill.

A further object of this invention resides in the provision of a novel, inexpensive dispenser which is capable of reproducibly dispensing preselected microliter volumes of liquid.

Further objects of this invention will appear as the description proceeds in connection with below-described drawings and the appended claims.

DESCRIPTION OF DRAWINGS

FIG. 8 is an enlarged transverse section taken substantially along lines 8—8 of FIG. 4;

FIG. 10 is a section taken substantially along lines 10—10 of FIG. 4;

FIG. 11 is an end view of a specially constructed washer which is used in the dispenser's plunger assembly; and FIG. 12 is a section similar to FIG. 10, but showing an alternate plunger embodiment.

DETAILED DESCRIPTION

Figure 1:
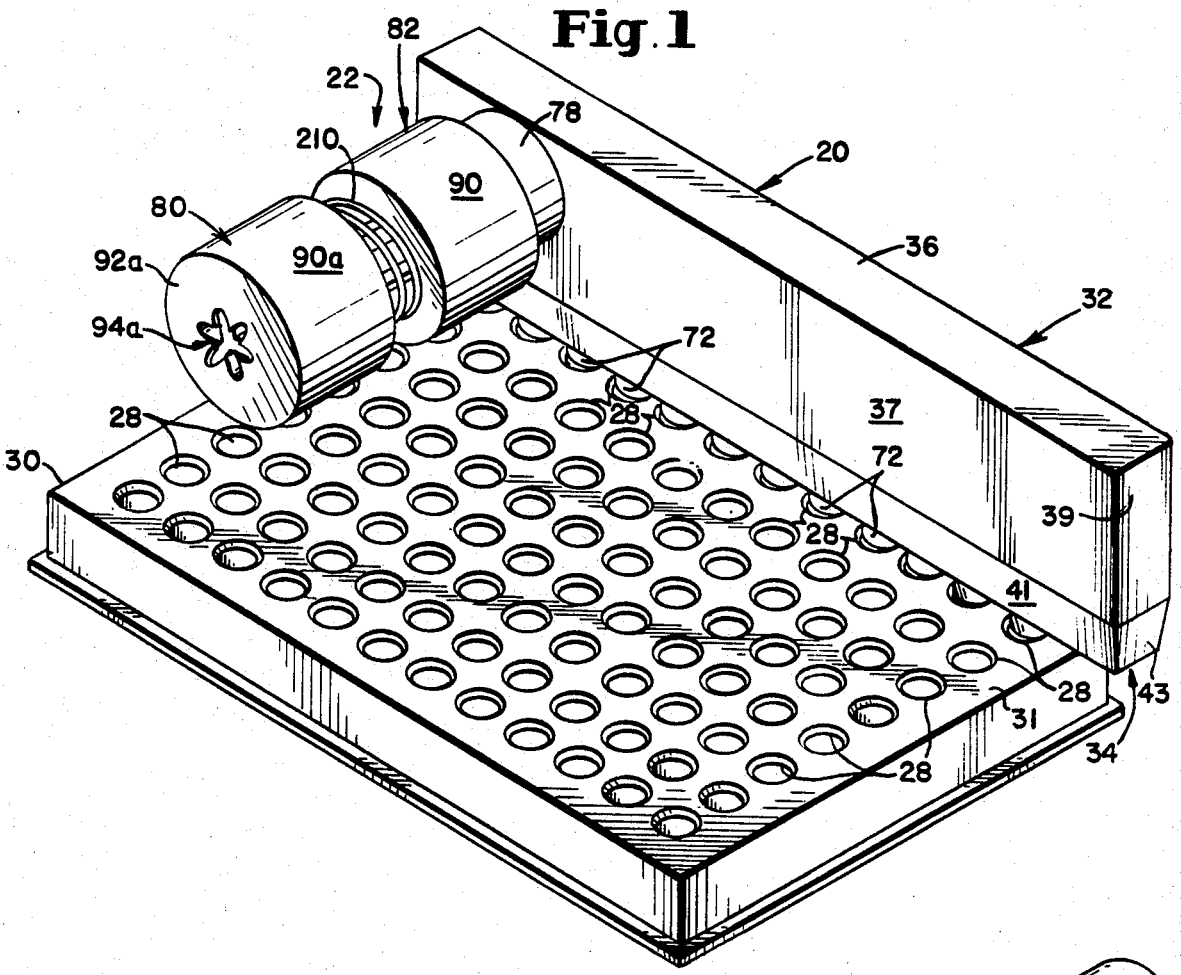
FIG. 1 is a perspective view showing the dispenser of this invention in its upright dispensing position on a standard 96-well microtitration plate.

Referring to the drawings and particularly to FIGS. 1 and 3–5, the disposable, hand-held dispenser of this invention is shown to consist of a hollow, rigid manifold or body 20 and a plunger assembly 22 removably mounted on manifold 20. Manifold 20 has the configuration of a parallelepiped and is formed with a set of dispensing tips 24 and a fill port 26. The term "manifold" is used to describe the dispenser's liquid-receiving body in the sense that it has a plurality of liquid outlets in the form of tips 24 and a separate, remotely located liquid inlet in the form of fill port 26.

Dispensing tips 24 are uniformly spaced apart lying in a straight row along the bottom of manifold 20 when the manifold is held in its upright dispensing position shown in FIG. 1. In the illustrated embodiment, tips 24 are particularly designed for use in dispensing liquid samples in the open-top, uniformly diametered wells 28 of a standard 96-well microtitration plate 30 (see FIG. 1). Wells 28 are uniformly spaced apart to form eight parallel spaced apart 12-well rows in one direction and twelve parallel spaced apart 8-well rows in a direction lying perpendicular to the first direction mentioned above. The open upper ends of wells 28 lie flush with a flat top wall 31 of plate 30. Microtitration plates of this type are described in U.S. Pat. No. 3,356,462 which issued to N. M. Cooke et al on Dec. 5, 1967.

Preferably, the number of dispensing tips on manifold 20 corresponds to the number of microtest wells 28 in each 12-well rows. Alternatively, manifold 20 may be provided with just eight dispensing tips, corresponding to the number of wells in each 8-well row. It also will be appreciated that manifold 20 may be provided with any other suitable number of dispensing tips for use with any suitable receptacles.

Plunger assembly 22, which will be described in greater detail later on, has a spring-biased plunger or piston 29 slidably mounted in port 26. Depressing or inward displacement of plunger 29 increases the air pressure in manifold 20 above the stored liquid to simultaneously dispense samples of the liquid through tips 24. After each dispensing stroke, plunger 29 is released for spring-biased return to its original, retracted position.

For manufacturing convenience, manifold 20 is a two part structure having an upper cap member 32 and a lower dispensing member 34 which fit together and open into each other to form the hollow manifold. Members 32 and 34 are preferably molded from polystyrene or other suitable plastic material.

Referring to FIGS. 1, 4, 5 and 8, cap member 32 is formed with a top wall 36, parallel, spaced apart, opposed, coextensive front and back walls 37 and 38, and parallel, spaced apart, opposed side walls 39 and 40 extending between walls 37 and 38. Walls 37–40 are flat-sided and define a rectangular skirt which depends from top wall 36. In cross-section, the configuration of cap 32 is rectangular both interiorly and exteriorly.

Still referring to FIGS. 1, 4, 5 and 8, the lower manifold dispensing member 34 is formed with coextensive, opposed, spaced apart front and back walls 41 and 42, a pair of opposed, parallel, spaced apart side walls 43 and 44 extending between walls 41 and 42, and a bottom wall 45. Walls 41–44 are flat-sided.

As best shown in FIG. 8, the adjoining ends of members 32 and 34 have complementary rabbeted or recessed configurations as indicated at 46 and 48 such that the lower open end of cap member 32 snugly and interfittingly receives the upper open end of dispensing member 34. Cap member 32 is fused to member 34, thereby sealing the two members along their interengaging regions to prevent leakage.

Still referring to FIG. 8, wall 41 lies parallel to and flush with wall 37. Wall 42, on the other hand, is sloped or inclined inwardly from the juncture with wall 38 in a direction extending towards wall 41 to provide manifold member 34 with a trough-like cross-section in the sense that the portion of the liquid chamber storage space progressively narrows from a wide dimension at the upper end of member 34 to a small dimension in the region of tips 24. In the illustrated embodiment, wall 42 is inclined at an angle of about 30° relative to wall 38. This construction has the effect of funneling stored liquid to dispensing tips 24 when manifold 20 is placed in its upright dispensing position shown in FIG. 1.

From the description thus far it will be appreciated that cap member 32 is permanently fixed on and closes the open upper end of the lower manifold dispensing member 34 in such a manner that the interior regions of the two manifold members 32 and 34 combine to define a single, uninterrupted reservoir or liquid storage chamber 50 (see FIG. 8). By this construction, the entire hollow interior of manifold 20 serves as the liquid reservoir and affords more than sufficient storage capacity for delivering the required volumes of liquid samples to all 96 wells in plate 30 without refill. This construction also serves to minimize the size of the dispenser so that it can conveniently be held and carried in one hand as well as being hand-held for operation as will be described in detail later on.

Referring to FIGS. 6–9, dispensing tips 24 are of identical construction, have the same dimensions, are coextensive and are integral with the manifold's bottom wall 45. Each of the dispensing tips 24 is formed with a small, straight, uniformly diametered flow passage 60 extending through the dispensing tip's body and opening directly into reservoir 50 as best shown in FIG. 8. Additionally, each of the dispensing tips 24 is formed with inner and outer conically contoured end portions 62 and 64, which terminate in oppositely facing, flat, annular end faces 66 and 68, respectively. The longitudinal axes of the dispensing tips' flow passages 60 lie in a common plane which, in the illustrated embodiment, extends parallel to the manifold's wall portions 37 and 41. The tips' end faces 68 lie in a common plane normally intersecting the tips' longitudinal axes and extending horizontally when manifold 20 is placed in a position where tips 24 extend vertically.

The inner dispensing tip end portions 62 lie within manifold 20 in reservoir 50. Each of the end portions 62 projects upwardly from and is coaxially surrounded by an annular trough or channel 70 in the manifold's bottom wall 45. This construction provides each of the end portions 62 with a raised boss-like configuration within manifold 20.

The outer end portions 64 of dispensing tips 24 depend or project downwardly from the manifold's bottom wall 45 on the exterior of the manifold. The conically contoured exteriors of end portions 62 and 64 lie in opposed conical envelopes which progressively decrease in diameter in axially opposite directions toward their respective end faces.

When plunger 29 is released and spring biased back to its original position following a dispensing stroke, air may be drawn up through tips 24 to create air bubbles at the inner ends of tips 24 within manifold 20. If these air bubbles are allowed to cling to the inner ends, they may be forced through tips 24 during an ensuing dispensing operation to objectionably reduce the dispensed volumes of liquid. Reducing the surface areas of end faces 66 reduces the collection of air bubbles at the inner ends of flow passages 60.

In the present invention, end faces 66 are each reduced to a very small surface area by the previously described raised boss-like conical configuration of end portions 62, thus inhibiting and reducing the collection of air bubbles on the end faces at the inner ends of flow passages 60. Lacking sufficient end face areas to cling to, the air bubbles are induced to rise to the surface of liquid stored in chamber 50. The dispensing tip configuration therefore enhances the uniformity of liquid volumes which are dispensed in successive plunger operations.

The conical configuration of end portions 64 likewise serve to reduce the surface areas of end faces 68 to a relatively small size. Reducing the surface areas of end faces 68 advantageously inhibits or reduces the tendency of liquid drops to cling to the outer ends of tips 24. Hanging drops are objectionable because they contribute to the discharge of non-uniform liquid volumes in successive dispensing operations.

Because of its capability of dispensing uniform microliter quantities of liquid in successive dispensing operations, the dispenser of this invention is suitable for use in such tests as antimicrobial susceptability tests where uniform, preselected quantities of bacteria and nutrient broth are required for different concentrations of antibodies to achieve accurate test results.

Figure 6:
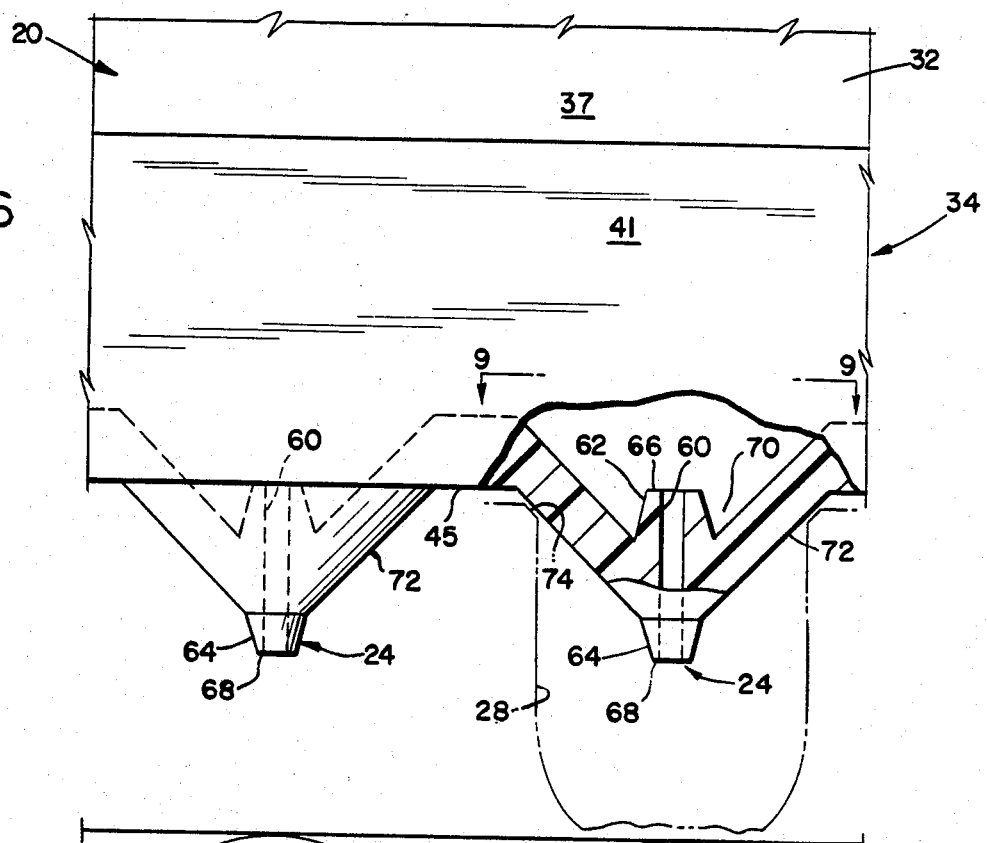
FIG. 6 is an enlarged fragmentary view of the elevation shown in FIG. 4 and illustrating the microtitration plate in phantom lines to show the seating engagement of the dispensing tips on the microtest wells.
Figure 7:
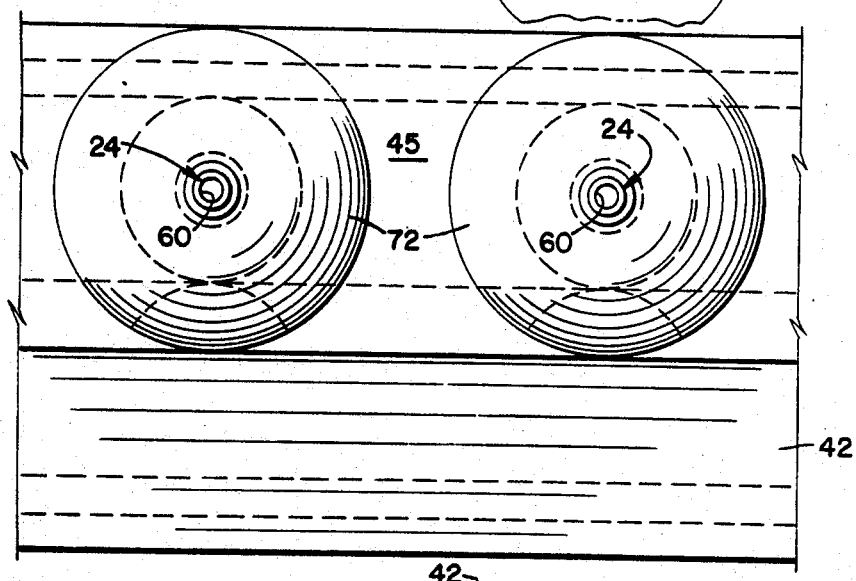
FIG. 7 is a fragmentary bottom plan view of the dispenser shown in the previous Figures.
Figure 9:
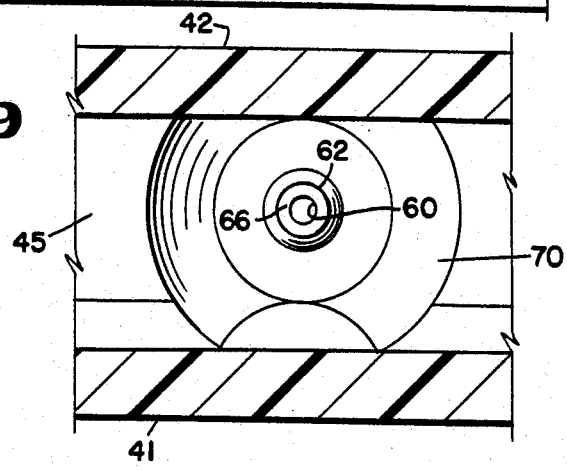
FIG. 9 is an enlarged section taken substantially along lines 9—9 of FIG. 6.

Referring to FIGS. 6 and 8, each of the dispensing tips is formed with an exterior conically contoured seating portion 72 which portions 72 integrally joins the tip's end portion 64 to the manifold's bottom wall 45. Portions 72 are conically contoured in the same direction as end portions 64. The outer peripheries of portions 72 lie in conical envelopes having uniform apex angles which are wider than the uniform apex angles of the conical envelopes containing the outer peripheries of end portions 64.

As shown in FIG. 6, the dispensing tips' conically contoured portions 72 are located and configured to interfittingly seat against the conically contoured lips 74 of wells 28 in plate 30. Portions 64 and 72 of each dispensing tip are coaxial with the longitudinal axis of the tip's flow passage 60.

Still referring to FIG. 6, the maximum diameter of each end portion 64 is significantly smaller than the uniform diameters of wells 28. When the dispenser of this invention is placed in its upright dispensing position on plate 30, end portions 64 will project downwardly into the aligning wells 28 at positions where they are radially spaced from the cylindrical side walls of the wells as shown in FIG. 6. In the dispenser's upright dispensing position portions 72 will interfittingly seat against lips 74 of wells 28 as shown in FIG. 6 to thus center dispensing tips 24 at positions where their flow passages 60 axially align with the longitudinal axes of wells 28. The interfitting seating engagement of portions 72 with the lips 74 of wells 28 further serve to establish a semi-fluid tight seal, thus inhibiting or diminishing the escape of airborne droplets from wells 28, thereby diminishing the chance of spreading contamination where the droplets contain bacteria or other contaminants.

In the illustrated embodiment, the diameter of each flow passage is 0.022 inches (0.06 cm), the maximum diameter of each end portion 64 is 0.055 inches (0.14 cm), the uniform spacing between the longitudinal axes of tips 24 is 0.355 inches (1.20 cm), corresponding to the spacing between wells 28, and the contour of each dispensing tip portion 72 lies in a conical envelope having a 45 degree apex angle.

Figure 2:
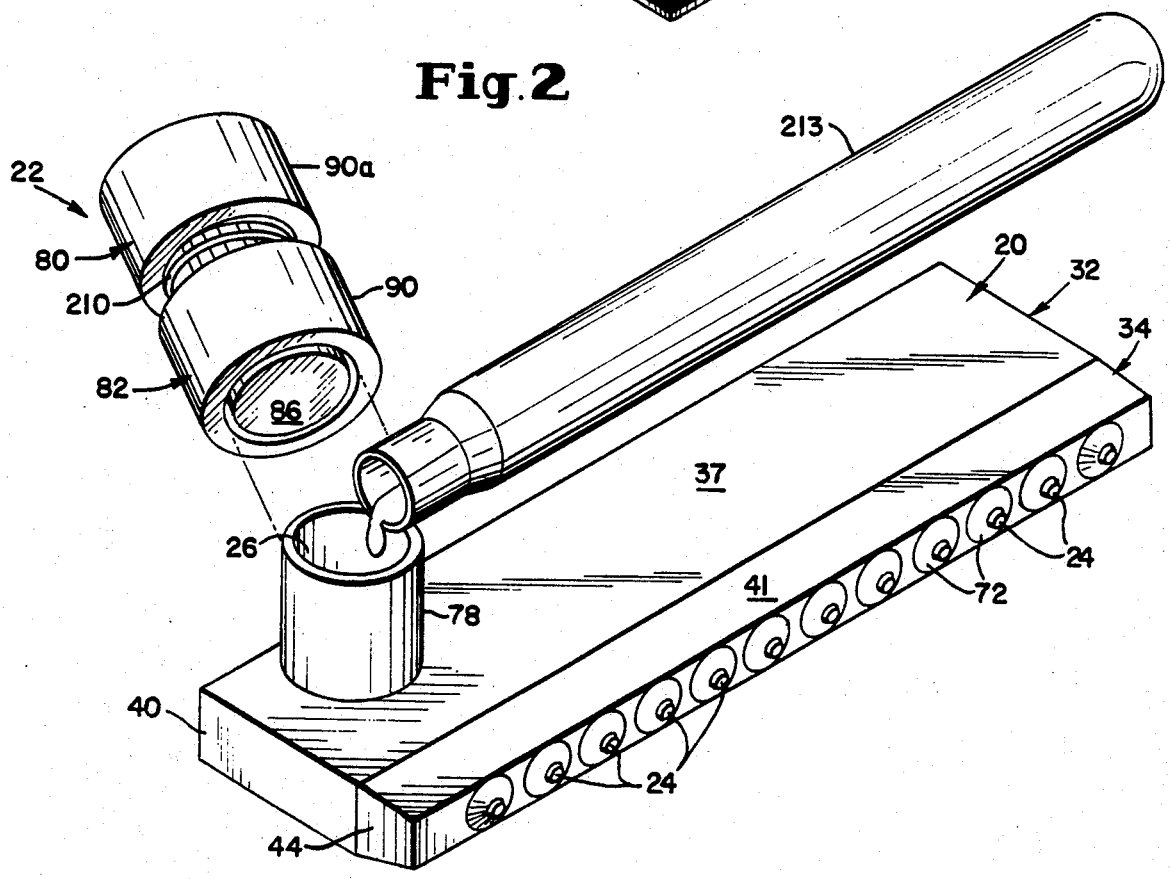
FIG. 2 is another perspective view showing the dispenser lying on its side with the plunger assembly removed for introducing a supply of liquid into the dispenser's manifold.
Figures 3, 4, 5:
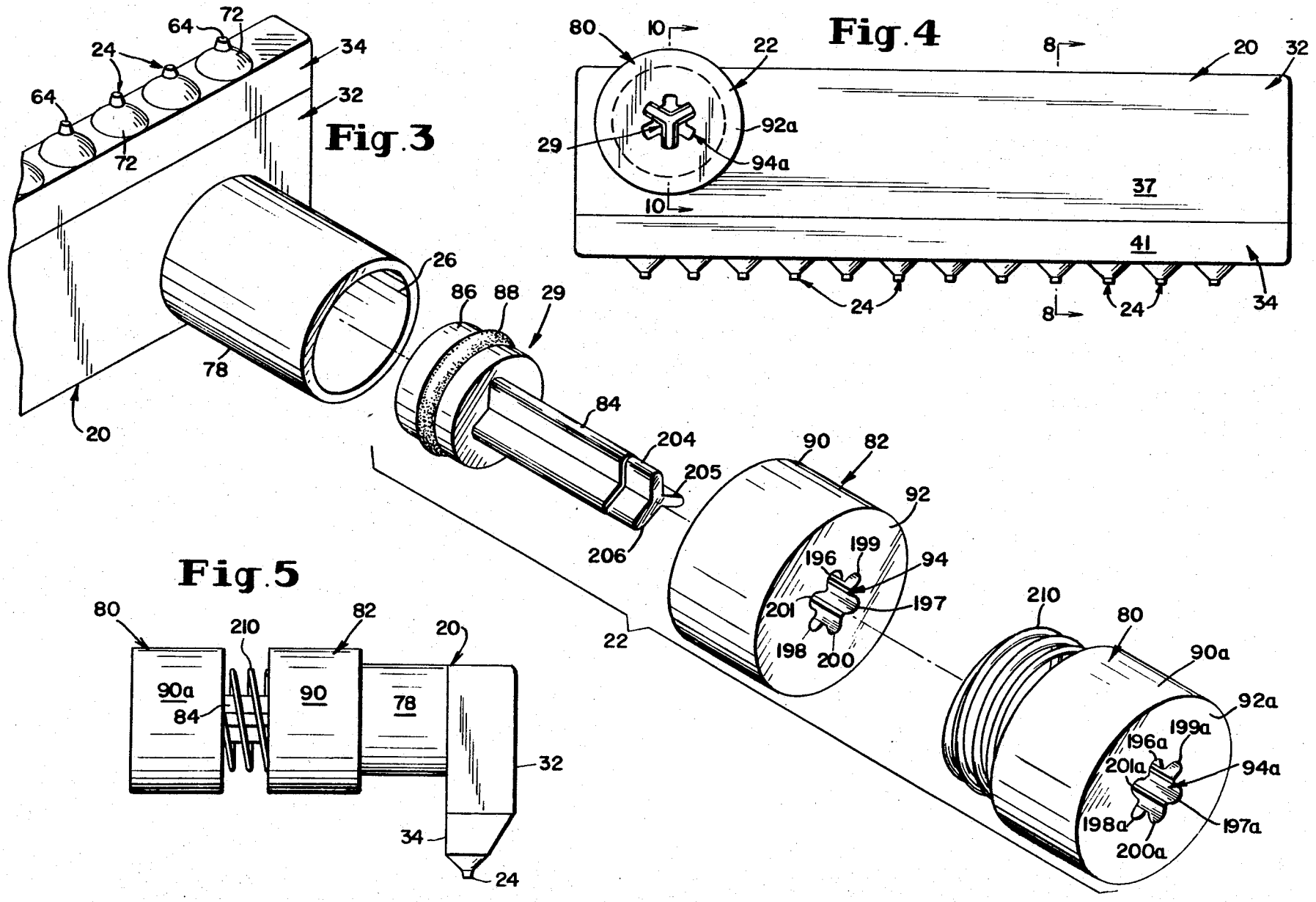
FIG. 3 is a fragmentary exploded perspective view of the dispenser shown in FIGS. 1 and 2.
FIG. 4 is a front elevation of the dispenser shown in the previous Figures as viewed from the plunger side of the manifold.
FIG. 5 is a side elevation of the dispenser shown in the previous Figures.

Referring to FIGS. 2, 3 and 10, fill port 26 is defined by a cylinder or annular collar 78 which is formed integral with manifold member 32. The longitudinal axis of collar 78 perpendicularly intersects a plane containing the longitudinal axes of dispensing tips 24.

Collar 78 extends laterally from wall 37 on the side of manifold 20 facing away from the side containing the sloped wall 42. Because of this construction, collar 78 will be in an upright or vertical filling position when manifold 20 is placed on its side where wall 38 seats against a support surface as shown in FIG. 2. Wall 38 has a relatively large rectangular area to stably support manifold 20 in its side filling position.

The interior of collar 78 opens directly into chamber 50 as shown in FIG. 10. No valves or any other flow blocking structures are provided between fill port 26 and chamber 50. Furthermore, no valves or any other flow blocking devices are provided between chamber 50 and the dispensing tips' flow passages 60.

Referring to FIGS. 3 and 10, plunger assembly 22 comprises a push cap 80 and a washer 82 in addition to plunger 29. Plunger 29 is formed with a spoked stem portion 84 which terminates at one end in a piston 86. Plunger 29, push cap 80 and washer 82 are advantageously molded from a suitable plastic such as polystyrene.

Piston 86 is slidably and coaxially received in collar 78. A groove-seated, elastically deformable seal ring 88 is mounted on piston 86 and is deformed against the smooth cylindrical interior of collar 78 to establish a fluid tight seal between piston 86 and collar 78.

Referring to FIGS. 3, 10 and 11, washer 82 is integrally formed with an annular skirt 90 and an end wall 92. Skirt 90 is open at its end opposite from end wall 92. End wall 92 is formed with a specially configured aperture 94 for receiving the plunger stem 84.

As best shown in FIG. 11, the periphery of aperture 94 is formed with six equiangularly spaced apart longitudinally extending grooves 196, 197, 198, 199, 200 and 201. Grooves 196–201 open radially inwardly into aperture 94. Alternate ones of grooves 196–201, as designated by the reference numerals 196–198, have uniform widths which are wider than the uniform widths of the remaining grooves 199–201. Grooves 196–198 define a first set and are equiangularly spaced apart from one another by 120 degree angles. Grooves 199–201 define a second set and are also equiangularly spaced apart from one another by 120 degree angles.

Washer 82 and push cap 80 are conveniently and advantageously of identical, interchangeable construction. Accordingly, like reference numerals have been used to identify like portions of the two parts except that the reference numerals used for push cap 80 have been suffixed by the letter "a" to distinguish them from the reference numerals used for washer 82.

As best shown in FIG. 3, stem 84 is integrally formed with three equiangularly spaced apart ribs 204, 205 and 206 extending radially from the plunger's longitudinal axis. Ribs 204–206 have equal widths and equal lengths.

Depending upon the angular orientation of washer 82 relative to stem 84, ribs 204–206 are adapted to fit into either the first set of washer grooves 196–198 or the second set of washer grooves 199–201. Likewise, depending upon the angular orientation of push cap 80 relative to stem 84, ribs 204–206 are adapted to fit into either the first set of cap grooves 196*a*–198*a* or the second set of cap grooves 199*a*–201*a*.

The widths of grooves 196–198 and 196*a*–198*a* provide a free sliding fit with ribs 204–206 on plunger 29. The widths of grooves 199–201 and 199*a*–201*a*, on the other hand, establish a tighter fit with ribs 204–206.

As best shown in FIG. 10, washer 82 is mounted on the free end of collar 78. The washer's skirt portion 90 interfittingly receives and seats against the outer cylindrical periphery of collar 78 with a sliding fit which permits washer 82 to be manually removed but yet is tight enough to prevent washer 82 from inadvertantly sliding off. A preloaded coiled biasing spring 210 holds washer 82 on collar 78. The washer's end wall 92 overlies the open outer end of collar 78 as shown.

Still referring to FIG. 10, plunger stem 84 extends through aperture 94 and projects axially beyond collar 78 and washer 82. The angular orientation of washer 82 with stem 84 is such that ribs 204–206 slidably extend through the larger grooves 196–198 of washer 82 to permit relative sliding movement between plunger 29 and washer 82. The engagement of ribs 204–206 in grooves 196–198 prevents relative rotation between washer 82 and plunger 29 so that washer 82 and plunger 29 are non-rotatably interlocked with each other.

The outer free end of stem 84 is received in aperture 94*a* of push cap 80. The angular orientation of push cap 80 relative to stem 84 is such that ribs 204–206 are received in the smaller grooves 199*a*–201*a* with a tight fit. Push cap 80 is fused to and thereby permanently fixed to stem 84. The engagement of ribs 204–206 in grooves 199*a*–201*a* prevents relative rotation between push cap 80 and plunger 29.

Still referring to FIG. 10, spring 210 encircles stem 84 and is compressed between the push cap's end wall 92*a* and the washer's end wall 92 to bias plunger 29 to its outward limiting position where piston 86 seats against the interior flat surface of the washer's end wall 92. Inward displacement of plunger 29 against the bias of spring 210 is limited by abutment of the push cap's free annular end face 212 with the opposed, exterior flat face of the washer's end wall 92. These stops limit longitudinal travel of plunger 29 to a distance d which is the dimension between end face 212 and the opposing exterior wall surface of the washer's end wall 92 when plunger 29 is biased to its outer position. Hence, dimension d sets and is equal to the length of the plunger dispensing stroke.

To introduce a supply of liquid into manifold 20, the complete plunger assembly 22 is removed from manifold 20 by gripping assembly 22 and pulling it off collar 78. The plunger's piston will be removed through the outer open end of collar 78 upon sliding plunger assembly 22 rearwardly.

Manifold 20 is then placed on its side where the manifold's wall 38 seats against a flat support surface (such as a bench) with collar 78 facing vertically upwardly as shown in FIG. 2. Liquid is then poured into manifold 20 through the open fill port 26 from a suitable receptacle or container.

In conducting an antimicrobial susceptability test, for example, a suspension of bacteria in a nutrient broth may be stored in a liquid vial 213 (see FIG. 2). With manifold 20 in its fill position, as shown in FIG. 2, the bacteria-containing suspension is poured out of the vial into manifold 20 through port 26. When lying on its side for filling, manifold 20 is preferably filled only to a level 214 (see FIG. 8) which lies below the level of the dispensing tips' flow passages 60. This prevents liquid in chamber 50 from being forced out through passages 60 upon insertion of plunger 29 in cylinder 78. The plastic used for molding manifold 20 is advantageously of the clear or translucent type, permitting observation of the liquid level in the mahifold.

After manifold 20 is filled to the proper level, plunger assembly 22 is reassembled on collar 78 by slidably inserting piston 86 into collar 78 and mounting washer 82 on collar 78. In the assembled positions of parts shown in FIG. 10, piston 86 and seal ring 88 serve as a stopper to prevent leakage of liquid through the manifold's fill port 26.

After assembling plunger assembly 22 on collar 78 the dispenser is then turned 90 degrees to its upright dispensing position (see FIG. 1) and is placed over microtitration plate 30 at a position where the dispensing tips' conically contoured seating portions 72 interfittingly seat against lips 74 of wells 28, thus centering dispensing tips 24 with their respective wells 28 in the selected 12-well row on plate 30. While holding the dispenser in this dispensing position the operator or user engages the end of push cap 80 with his thumb or other finger pushing it inwardly against the bias of spring 210 until the push cap's end face 212 seats against the washer's end wall 92. The resulting dispensing strike of piston 86 through the distance d increases the pressure of air in manifold 20 above the stored body of liquid, thus forceably ejecting or dispensing uniform microliter quantities of the liquid through dispensing tips 24 and into wells 28.

Upon completion of the plunger dispensing stroke, the push cap 80 is released, allowing spring 210 to bias the plunger 29 back to its original, retracted position where piston 86 seats against the washer's end wall 90 in preparation for the next dispensing operation.

If more than twelve of the wells are to be used in plate 30, the dispenser is then transferred to the next 12-well row, and push cap 80 is again pushed inwardly causing plunger 29 to travel its full dispensing stroke d to dispense another set of twelve liquid samples of the same, uniform volumes as previously dispensed. This procedure is repeated until samples are dispensed into all wells required for a particular test.

The liquid storage capacity of manifold 20 is large enough to store more than enough liquid for dispensing 96 liquid samples in sets of twelve.

From the foregoing description it will be appreciated that the complete dispenser (i.e., manifold 20 and plunger unit 22) is relatively small. As shown in FIG. 1, the width or major dimension of manifold 20 extending parallel to a plane containing the longitudinal axes of dispensing tips 24 is only slightly larger than the corresponding long dimension of a standard microtitration plate extending parallel to the plate's 12-well rows. Furthermore, the height of manifold 20 is relatively small and is considerably less than the width mentioned above. Still further, the depth of manifold 20 is also small and significantly less than the height of the manifold so that the manifold itself is relatively narrow.

As viewed from FIG. 1, plunger assembly 22 is located near the upper left hand corner of manifold 20 for easy and convenient manipulation. In a dispensing operation, the user may grasp and steady the dispensed by placing both hands at positions where the palms of the hands lie opposite the manifold's oppositely facing side wall portions to grip the manifold between the non-thumb fingers along the manifold's back wall opposite from plunger assembly 22 and the thumbs on the manifold's front side containing plunger assembly 22. In this position, plunger 29 may be pushed inwardly for a dispensing stroke by engaging push cap 80 with the left hand thumb.

Alternatively, the dispenser may be grasped in the opposite manner by placing both thumbs along the manifold's back side opposite from the plunger assembly 22 and by placing the non-thumb fingers along the manifold's front side containing plunger assembly 22. In this gripping position plunger 29 can be pressed inwardly by engaging push cap 80 with the index finger of the right hand. The dispenser of this invention is therefore convenient and easy to use for both right-handed and left-handed users.

In the dispenser of this invention, the uniform diameters of the dispensing tip flow passages 60 are made small enough so that when the dispenser is held in its upright dispensing position, the fluid flow friction and liquid surface tension in passages 60 are great enough to prevent liquid from flowing through the passages under an existing head before plunger 29 is depressed to increase the manifold's internal air pressure. Flow passages 60 have equal diameters and equal lengths. Because of this construction, the liquid volumes dispensed through tips 24 for each plunger dispensing stroke will be equal or at least substantially equal.

The sum of the liquid volumes delivered through tips 24, however, is controlled and thus determined by the plunger dispensing stroke d. The length of stroke d is fixed at a preselected value in the manufacture of plunger assembly 22. For example, dimension d may be set to dispense a total of 1,200 microliters of liquid. With tips 24 designed to deliver equal liquid volumes, the volume dispensed through each dispensing tip will therefore be 100 microliters.

A set of plunger assemblies having different preselected plunger stroke lengths may be supplied where it is desired to dispense different volumes of liquid samples with the same manifold or different manifolds. Dispensing of different liquid volumes may therefore be achieved simply by substituting one plunger assembly for another.

Spring 210 is preloaded to assume that the length of the plunger's dispensing stroke will be the same for repeated dispensing strokes.

It will be appreciated that the seating engagement of the dispensing tips' seating portions 76 against lips 74 of wells 28 serves to steady the dispenser in its upright dispensing position on plate 30 as shown in FIG. 1. Because of this seating engagement plate 30 serves to support the dispenser in its dispensing position so that it does not have to be suspended in the air and supported entirely by the user during a dispensing operation.

A modified plunger assembly 22' is shown in FIG. 12. To the extent that plunger assemblies 22 and 22' are the same, like reference characters have been used to identify like parts except that the reference characters used for identifying the parts in plunger assembly 22' have been primed to distinguish them from the reference characters used for plunger assembly 22.

As shown in FIG. 12, plunger 29' is the same as plunger 29 except that plunger 29' is provided with a smooth, cylindrical stem 230.

In the embodiment shown in FIG. 12, washer 82 is replaced by a flat-sided annular washer 232 having a smooth, cylindrical bore or aperture 234 which freely and slidably receives the plunger's cylindrical stem 230. Washer 232 is held against the outer end of collar 78 by the bias exerted by spring 210'. The configuration of push cap 80' is the same as that of push cap 80 except that the push cap's end wall 92a' is formed with a cylindrically smooth aperture 236 which tightly receives a reduce diametered plunger stem and section 238. Push cap 80' is fused to or otherwise fixed to stem 230.

Plunger assembly 22' is removed from manifold 20 simply by sliding it rearwardly to open fiil port 26. Operation of plunger assembly 22' corresponds to the operation described for plunger assembly 22.

From the foregoing description it will be appreciated that the dispenser of this invention in relatively inexpensive and has relatively few parts, totalling seven parts in all, where five are molded from plastic. Furthermore, it is apparent from the foregoing that the dispenser is ruggedly constructed for reuse in non-contaminating application.

Instead of being manually operated, the portable, disposable dispenser of this invention may be placed in a fixture (not shown) to operate the plunger assembly (22, 22') with a mechanically operated driver in a condition-responsive automatic dispensing system or in a semi-automatic dispensing system wherein the mechanical driver is selectively operated.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A disposable hand-held dispenser for dispensing microliter quantities of non-contaminatable and contaminatable liquids, including bacteria-containing suspensions, in chemical and biological procedures, comprising a hollow rigid body defining a liquid storage chamber and terminating at one end in a plurality of parallel dispensing tips, said body having a fill port which is separate from said dispensing tips and which is in fluid communication with said chamber for introducing liquid into said chamber for storage therein, a fluid flow passage formed through each of said tips and opening into said chamber, said tips being uniformly spaced apart in a single straight row to register with open top microtitration wells which are arranged in a straight row, the longitudinal axes of said tips lying in a common plane which transversely intersects the longitudinal axis of said fill port, said fill port being located to open upwardly to permit liquid to be poured into said chamber when said body is placed on one of its sides where said common plane extends horizontally, said body being placeable in a dispensing position where said tips project downwardly and underlie the stored liquid in said chamber and where said chamber provides an enclosed air space overlying the stored liquid when said chamber is partially filled with liquid, and means carried on said body for selectively increasing the pressure of air in said air space to dispense preselected quantities of the stored liquid simultaneously through the passages of said tips for reception in said wells, said quantities being at least substantially equal, said means for selectively increasing the air pressure in said air space comprising cylinder means for receiving a plunger, said cylinder means being rigid with said body and opening into said chamber, a plunger slidably received in said cylinder means for manual longitudinal displacement in a direction to increase the air pressure in said air space, and means establishing a liquid-tight seal between said plunger and said cylinder means to keep liquid in said chamber from flowing out through said fill port, said cylinder means defining said fill port, and said plunger being selectively removable to open said fill port for introducing a supply of liquid into said chamber, the fluid flow passages through said tips being straight and having equal lengths, and the diameters of said passages being equal.

2. The disposable hand-held dispenser defined in claim 1 wherein said body comprises first and second opposed spaced apart wall portions and a third wall portion, said tips being integral with and projecting from said third wall portion, said fill port comprising an aperture formed through said first wall portion, said fill port being oriented to open upwardly when said body is placed in a position where said seoond wall portion is seated on a horizontal support surface.

3. The disposable hand-held dispenser defined in claim 2 wherein said second wall portion has a flat exterior wall surface extending parallel to said plane.

4. The disposable hand-held dispenser defined in claim 3 wherein said body comprises a fourth wall portion and a juncture between said second and fourth wall portions, said first, second, third and fourth wall portions delimiting said chamber, and said fourth wall portion extending from said second wall portion to said third wall portion and being inclined toward said first wall portion from said juncture between said second and fourth wall portions such that the spacing between said first and fourth wall portions progressively decreases in a direction extending toward the inner ends of the fluid flow passages through said tips.

5. The disposable hand-held dispenser defined in claim 4 wherein the entire hollow interior of said body defines said chamber.

6. The disposable hand-held dispenser defined in claim 2 wherein the entire hollow interior of said body defines said chamber and wherein said body is formed entirely from a plastic material.

7. The disposable hand-held dispenser defined in claim 1 wherein each of said tips has an inner portion projecting into said chamber and terminating in an annular end face, said inner portion having an outer conically contoured wall surface which progressively decreases in diameter in a direction extending toward said end face.

8. A disposable hand-held dispenser for dispensing microliter quantities of non-contaminatable and contaminatable liquids, including bacteria-containing suspensions, in chemical and biological procedures, comprising a hollow rigid body defining a liquid storage chamber and terminating at one end in a plurality of parallel dispensing tips, said body having a fill port which is separate from said dispensing tips and which is in fluid communication with said chamber for introducing liquid into said chamber for storage therein, said body further comprising first and second opposed spaced apart wall portions and a third wall portion, said tips being integral with and projecting from said third wall portion, said fill port comprising an aperture formed through said first wall portion, the longitudinal axes of said tips being contained in a common plane which transversely intersects the longitudinal axis of said fill port, said fill port being oriented to open upwardly when said body is placed in a position where said second wall portion is seated on a horizontal support surface, a fluid flow passage formed through each of said tips and opening into said chamber, said tips being uniformly spaced apart in a single straight row to register with open top microtitration wells which are arranged in a straight row, said body being placeable in a dispensing position where said tips project downwardly and underlie the stored liquid in said chamber and where said chamber provides an enclosed air space overlying the stored liquid when said chamber is partially filled with liquid, and means carried on said body for selectively increasing the pressure of air in said air space to dispense preselected quantities of the stored liquid simultaneously through the passages of said tips for reception in said wells, said quantities being at least substantially equal, said means for selectively increasing the air pressure in said air space comprising cylinder means for receiving a plunger, said cylinder means being rigid with said body and opening into said chamber, and a plunger slidably received in said cylinder means and being manually pushable to effect the increase of air pressure in said air space for dispensing samples of the stored liquid in said chamber through said tips, said plunger being disposed at a location where it can be pushed with one finger while the user grasps the body along said first and second wall portions, said cylinder means defining said fill port, and said plunger being selectively removable from said cylinder means to open said fill port for introducing a supply of liquid into said chamber.

9. A disposable hand-held dispenser for dispensing microliter quantities of non-contaminatable and contaminatable liquids, including bacteria-containing suspensions, in chemical and biological procedures, comprising a hollow rigid body defining a liquid storage chamber and terminating at one end in a plurality of parallel dispensing tips, said body having a fill port which is separate from said dispensing tips and which is in fluid communication with said chamber for introducing liquid into said chamber for storage therein, a fluid flow passage formed through each of said tips and opening into said chamber, said tips being uniformly spaced apart in a single straight row to register with open top microtitration wells which are arranged in a straight row, said body being placeable in a dispensing position where said tips project downwardly and underlie the stored liquid in said chamber and where said chamber provides an enclosed air space overlying the stored liquid when said chamber is partially filled with liquid, and means carried on said body for selectively increasing the pressure of air in said air space to dispense preselected quantities of the stored liquid simultaneously through the passages of said tips for reception in said wells, said quantities being at least substantially equal, said means for selectively increasing the air pressure in said air space comprising a plunger arranged for a liquid dispensing stroke, cylinder means rigid with said body and slidably receiving said plunger, said cylinder means opening into said body and defining said fill port, there being means for limiting the liquid dispensing stroke of said plunger to a predetermined distance between first and second axially spaced apart limiting positions, and spring means for biasing said plunger to said first position, said plunger being selectively displaceable against the bias of said spring means to said second position to effect the liquid-dispensing increase in the pressure of air in said air space, the spacing between said first and second positions controlling the sum of the liquid volumes dispensed through said tips for each dispensing stroke of said plunger, and only one liquid sample of preselected volume being dispensed through each of said tips for each dispensing stroke of said plunger from said first position to said second position.

10. The disposable hand-held dispenser defined in claim 9 wherein the liquid storage capacity of said chamber is large enough to store enough liquid for dispensing more than one liquid sample of said preselected volume through each of said tips.

11. The disposable hand-held dispenser defined in claim 9 wherein the liquid storage capacity of said chamber is large enough to store enough liquid for successively dispensing eight liquid samples of at least 100 microliters each through each of said tips.

12. The disposable hand-held dispenser defined in claim 9 wherein said cylinder means has an open outer end, said dispenser including a part having a skirt portion coaxially receiving said cylinder means and an end wall at one end of said skirt portion for covering the open outer end of said cylinder means, said end wall having a central aperture, and said plunger having a stem slidably extending through said central aperture and having a free, outer end, and a push cap mounted on the free, outer end of said plunger stem, said spring means being confined between said end wall and said push cap, and the liquid dispensing stroke of said plunger being limited by abutment of said push cap against said end wall.

13. The disposable hand-held dispenser defined in claim 12 wherein said part and said push cap are interchangeable and are identical in construction.

14. A disposable hand-held dispenser for dispensing microliter quantities of non-contaminatable and contaminatable liquids, including bacteria-containing suspensions, in chemical and biological procedures, comprising a hollow rigid body defining a liquid storage chamber and terminating at one end in a plurality of parallel dispensing tips, a fluid flow passage formed through each of said tips and opening into said chamber, said tips being uniformly spaced apart in a single straight row to register with separate open top microtitration wells in a microtitration plate, said body being placeable in a dispensing position where said tips project downwardly to register with certain wells in said plate, means carried on said body for selectively dispensing preselected, microliter quantities of the liquid stored in said chamber simultaneously through the fluid flow passages of said tips for reception in the wells of said plate, and seating means on said tips, said seating means being disposed to seat against portions of said plate for enabling said body to be supported on said plate while it is being grasped in the user's hands during the dispensing of liquid into the wells of said plate.

15. The disposable hand-held dispenser defined in claim 14 wherein said seating means includes exterior seats which are adapted to seat against portions of said wells which are adapted to center said tips on said wells.

16. The disposable hand-held dispenser defined in claim 15 wherein said portions of said wells are beveled lips at the open ends of said wells, and wherein said seats are conically contoured and adapted to seat against said lips to diminish the escape of airborne droplets from said wells.

17. The disposable hand-held dispenser defined in claim 15 wherein each of said tips has a well-engaging seat and a conically contoured outer end portion associated with and extending from a well-engaging seat and progressively decreasing in diameter in a direction extending toward the dispensing tip's liquid discharge end, the maximum diameter of said end portion being less than the diameters of said wells, and the outer end portions of said tips being adapted to be received in said wells when said seat arm seated on the lips of said wells.

18. The disposable hand-held dispenser defined in claim 14 wherein said seating means comprises an exterior, conically contoured seating surface formed one on each of said tips and adapted to interfittingly seat against conically contoured lips on said wells to center said tips with respect to said wells and to diminish the escape of airborne droplets from said wells.

19. A disposable hand-held dispenser for dispensing quantities of non-contaminatable and contaminatable liquids, including bacteria-containing suspension, in chemical and biological procedures, comprising a hollow rigid body defining a liquid storage chamber and terminating at one end in a plurality of parallel spaced apart dispensing tips which are arranged in a single straight row, said body having a fill port which is separate from said dispensing tips and which is in fluid communication with said chamber for introducing liquid into said chamber for storage therein, a straight fluid flow passage formed through each of said tips and opening into said chamber, the fluid flow passages through said tips having equal lengths, and the diameters of said passages being the same, said body being placeable in a dispensing position where said tips project downwardly and underlie the stored liquid in said chamber and where said chamber provides an enclosed air space overlying the stored liquid when said chamber is partially filled with liquid, and means carried on said body for selectively increasing the pressure of air in said air space to dispense preselected quantities of the stored liquid simultaneously through the fluid flow passages of said tips, said quantities being at least substantially uniform, said means for selectively increasing the air pressure in said air space comprising a plunger arranged for a liquid dispensing stroke, cylinder means rigid with said body and slidably receiving said plunger, said cylinder means opening into said body and defining said fill port, there being means for limiting the liquid dispensing stroke of said plunger to a predetermined distance between first and second axially spaced apart limiting positions, and spring means for biasing said plunger to said first position, said plunger being selectively displaceable against the bias of said spring means to said second position to effect the liquid-dispensing increase in the pressure of air in said air space, the spacing between said first and second positions controlling the sum of the liquid volumes dispensed through said tips for each dispensing stroke of said plunger, and only one liquid sample of preselected volume being dispensed through each of said tips for each dispensing stroke of said plunger from said first position to said second position.

20. The disposable hand-held dispenser defined in claim 19 wherein the longitudinal axes of said tips lie in a common plane which perpendicularly intersects the longitudinal axis of said fill port, said fill port being located to open upwardly to permit liquid to be poured into said chamber when said body is placed on one of its sides where said common plane extends horizontally.

21. The disposable hand-held dispenser defined in claim 19 wherein said body comprises first and second opposed spaced apart wall portions and a third wall portion, said tips being integral with and projecting from said third wall portion, said fill port comprising an aperture formed through said first wall portion, the longitudinal axes of said tips being contained in a common plane which transversely intersects the longitudinal axis of said fill port, said fill port being oriented to open upwardly when said body is placed in a position where said second wall is seated on a horizontal support surface.

22. The disposable hand-held dispenser defined in claim 21 wherein said second wall portion has an exterior wall surface extending parallel to said plane.

23. The disposable hand-held dispenser defined in claim 22 wherein said body comprises a fourth wall portion and a juncture between said second and fourth wall portions, said first, second, third and fourth wall portions delimiting said chamber, said third wall portion extending between said first and fourth wall portions, and said fourth wall portion extending from said second wall portion to said third wall portion and being inclined toward said first wall portion from a juncture between said second and fourth wall portions such that the spacing between said first and fourth wall portions progressively decreases in a direction extending toward the inner ends of the fluid flow passages through said tips.

24. The disposable hand-held dispenser defined in claim 23 wherein the entire hollow interior of said body defines said chamber.

25. The disposable hand-held dispenser defined in claim 19 wherein each of said tips has an inner portion projecting into said chamber and terminating in an annular end face, said inner portion having an exterior conically contoured wall surface which progressively decreases in diameter in a direction extending toward said end face.

* * * * *